US005658225A

United States Patent [19]

Huang

[11] Patent Number: 5,658,225

[45] Date of Patent: Aug. 19, 1997

[54] STRUCTURE OF ROWING MACHINE

[75] Inventor: Ma-Li Hsu Huang, Taipei Hsien, Taiwan

[73] Assignee: Chan-Nan Liu, Taipei Hsien, Taiwan

[21] Appl. No.: 570,009

[22] Filed: Dec. 14, 1995

[51] Int. Cl.[6] ..... A63B 69/06

[52] U.S. Cl. ..... 482/72; 482/95; 482/96; 482/112

[58] Field of Search ..... 482/57, 95, 70, 482/96, 72, 51, 106, 110, 111

[56] References Cited

U.S. PATENT DOCUMENTS 5,342,269 8/1994 Huang et al. ..... 482/95
5,453,066 9/1995 Richter ..... 482/96
5,458,553 10/1995 Wu ..... 482/95
5,507,709 4/1996 Wu ..... 482/72

*Primary Examiner*—Jerome Donnelly

[57] ABSTRACT

A rowing machine including a base frame, a flat and elongated seat frame pivoted to the base frame, a sliding seat sliding on the seat frame, two handles pivoted to the base and provided with a respective hydraulic cylinder for providing resistance to rowing action, and two pedals supported on a substantially V-shaped rocker arm. The seat frame is movably supported by the substantially V-shaped rocker above the base frame. The seat frame has a front end pivoted to the front end of the base frame and a rear end connected to the rear end of the base frame by a hydraulic cylinder.

1 Claim, 4 Drawing Sheets

STRUCTURE OF ROWING MACHINE

BACKGROUND AND SUMMARY OF THE INVENTION

The present invention relates to rowing machines, and relates more particularly to such a rowing machine in which the seat frame oscillates up and down when the sliding seat is reciprocated on the seat frame during the operation of the machine.

FIG. 1 shows a conventional rowing machine. This structure of a rowing machine comprises a flat and elongated seat frame, two handles supported on a respective hydraulic cylinder for rowing, and a sliding seat slidably mounted on the seat frame for sitting. The two opposite ends are fixedly secured in place. When the rowing machine is operated, the sliding seat is reciprocated on the seat frame.

The present invention provides a rowing machine which permits the seat frame to oscillate up and down when the sliding seat is reciprocated on the seat frame.

According to the preferred embodiment of the present invention, the rowing machine comprises a base frame, a flat and elongated seat frame, a sliding seat sliding on the seat frame, two handles pivoted to the base frame and arranged with a respective hydraulic cylinder, providing resistance to rowing action, and two pedals respectively supported on the base frame by arm pedals bars. The seat frame has a front end pivoted to one end of the base frame and a rear end connected to an opposite end of the base frame by a hydraulic cylinder. A rocker arm (or lever) is pivoted to the base frame. The rocker arm is arranged to permit the seat frame to oscillate up and down when the sliding seat is moved back and forth on the seat frame during the operation of the machine. The rocker arm comprises a front end arranged underneath the seat frame near its front end, a rear end coupled with a roller disposed in contact with the seat frame, a middle part disposed at a lower elevation than the front end and rear end of the rocker arm and pivoted to a middle support on the base frame by a pivot, and two pedal bars connected to the front end thereof at two opposite sides to hold the pedals.

DETAILED DESCRIPTION OF THE PREFERRED EMBODIMENT

Figure 1:
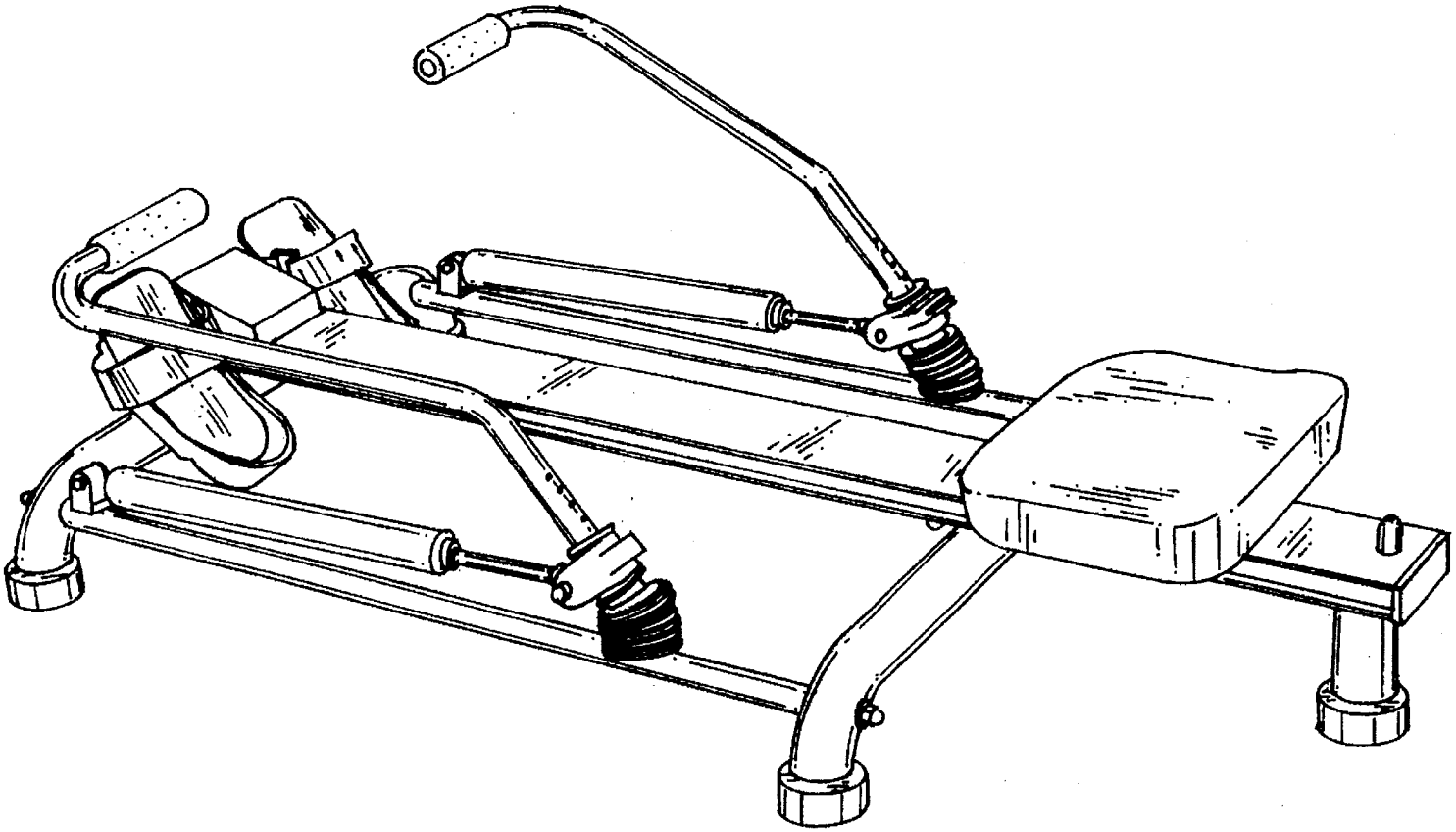
Fig. 1 PRIOR ART
FIG. 1 is an elevational view of a rowing machine according to the prior art.
Figure 2:
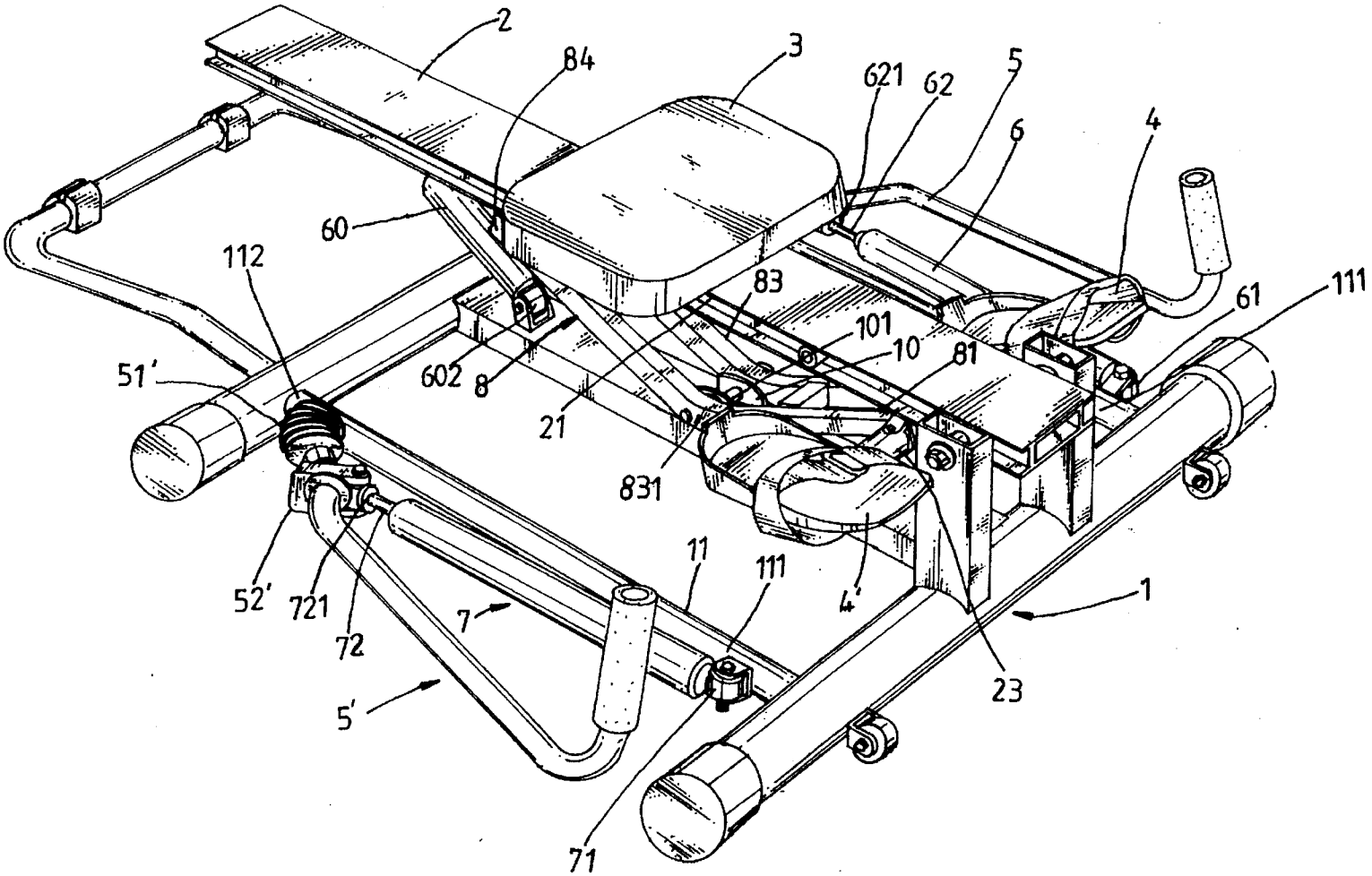
FIG. 2 is an elevational view of a rowing machine according to the present invention.
Figure 3:
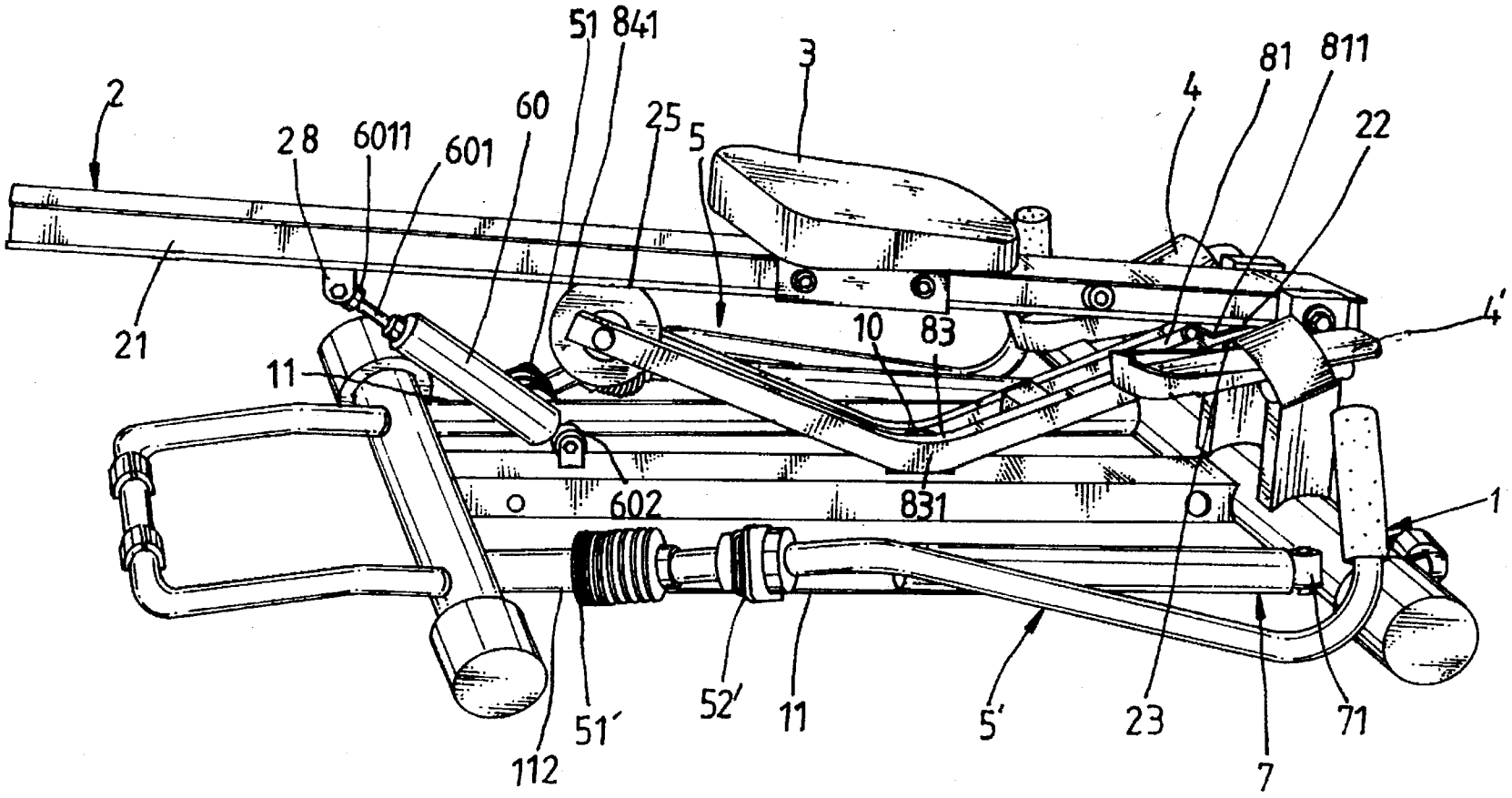
FIG. 3 is an operative view of the present invention showing the seat frame of the rowing machine lowered.
Figure 4:
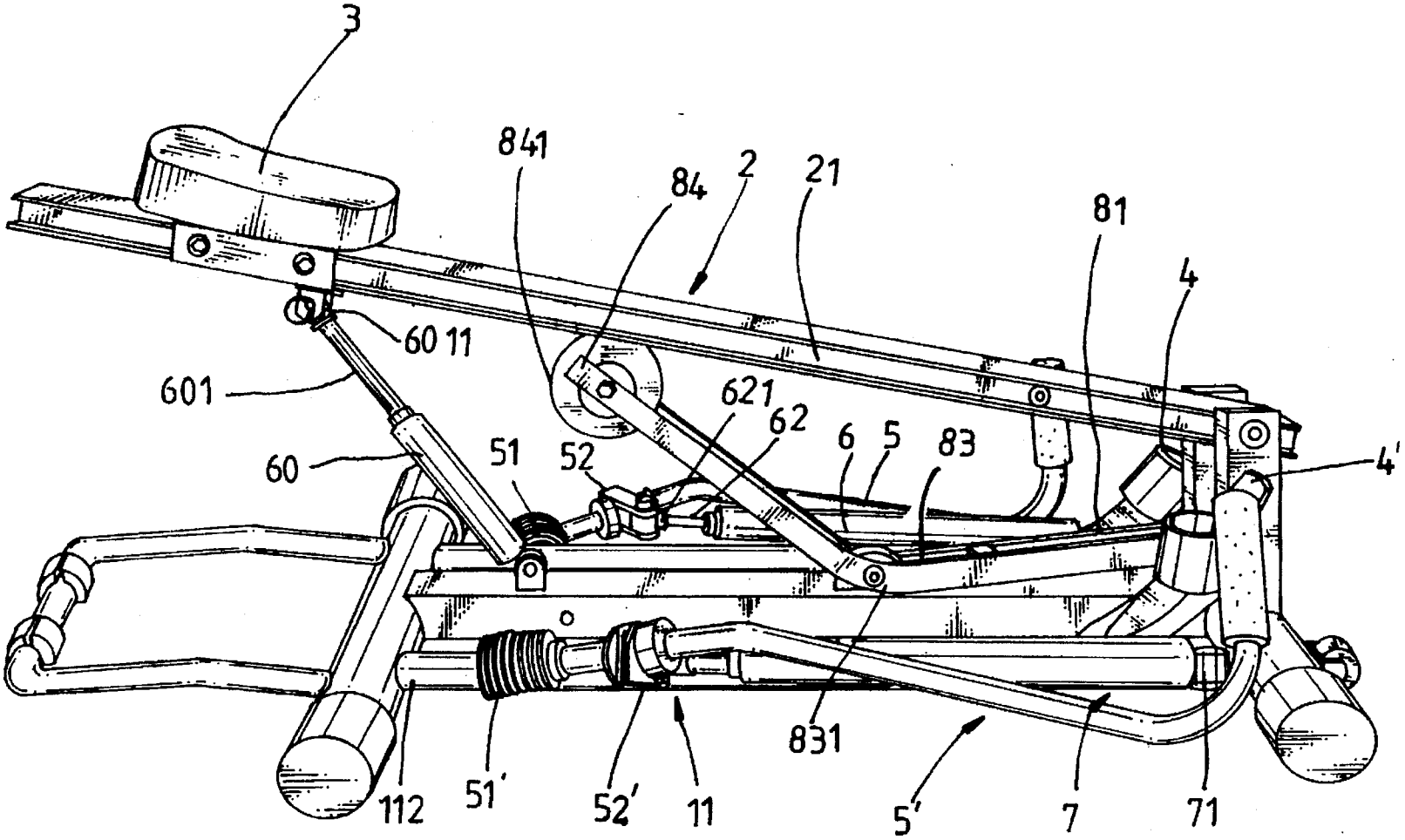
FIG. 4 is another operative view of the present invention showing the seat frame of the rowing machine lifted.

Referring to FIGS. 2, 3, and 4, the rowing machine of the preferred embodiment of the present invention is generally comprised of a base frame 1, a flat, elongated seat frame 2, a sliding seat 3, a pair of pedals 4 and 4', a pair of handles 5 and 5', and a rocker arm 8. The base frame 1 comprises two axles 11 longitudinally disposed at two opposite sides in a parallel relation, and two hydraulic cylinders 6 and 7 respectively connected to the front end 111 of one of the axles 11. Each of the hydraulic cylinders 6 and 7 has a rear end 61 or 71 connected to the front end 111 of one axle 11. The front end 621 or 721 of the piston-rod 62 or 72 is pivoted to one handle 5 or 5'. The handles 5 and 5' have a respective fixed end 51 or 51' pivotably connected to the rear ends 112 of the axles 11. The seat frame 2 comprises two longitudinal side tracks 21 at two opposite lateral sides for mounting the sliding seat 3. The sliding seat 3 has pulleys (not shown) bilaterally disposed at the bottom and respectively moved in the tracks 21. The handles 5 and 5' include a respective locating block 52 or 52'. The front end 621 and 721 of the hydraulic cylinders 6 and 7 are respectively pivoted to the locating blocks 52 and 52' of the handles 5 and 5'. When the user sits on the sliding seat 3 with his/her feet in the pedals 4 and 4', the handles 5 and 5' can be moved back and forth with the hands. When rowing, the sliding seat 3 is moved forwards and backwards on the seat frame 2.

The structural features of the present invention are outlined hereinafter with referenced to FIGS. 2, 3, and 4 again. The front end of the seat frame 2 is pivoted to the front end of the base frame 1. A hydraulic cylinder 60 is connected between the seat frame 2 and the base frame 1 at the rear end. The rear end 602 of the hydraulic cylinder 60 is pivoted to the rear end of the base frame 1. The front end 6011 of the piston rod 601 of the hydraulic cylinder 60 is pivoted to a bottom coupling portion 28 near the rear end of the seat frame 2. The rocker arm 8 has a V-shaped profile. The middle part 83 of the rocker arm 8 is disposed at a lower elevation relative to the two opposite ends 81 and 84 thereof. The lower end 831 of the middle part 83 is pivotably connected-to a middle support 10 on the base frame 1 by a pivot 101. The top edge 811 of the front end 81 of the rocker arm 8 is stopped at a front bottom wall 22 of the seat frame 2. Two pedal bars 23 are fixedly secured to the front end 81 of the rocker arm 8 at two opposite sides for mounting the pedals 4 and 4'. The pedals 4 and 4' are respectively turned about the pedal bars 23. A roller 841 is mounted on the rear end 84 of the rocker arm 8. The periphery of the roller 841 is disposed in contact with a rear bottom wall 25 of the seat frame 2.

Referring to FIGS. 3 and 4 again, when the rowing machine is operated, the sliding seat 3 is moved back and forth on the seat frame 2, and at the same time the seat frame 2 is oscillated up and down. When the sliding seat 3 is moved to the rear end of the seat frame 2, a downward pressure is given to the seat frame 2 to surpass the supporting force of the piston rod 601 of the hydraulic cylinder 60, therefore the seat frame 2 is lowered, and the piston rod 601 is retracted.

When the sliding seat 3 is moved the front end of the seat frame 2, the piston rod 601 is extended, and the seat frame 2 is lifted.

I claim:

1. A rowing machine comprising a base frame with a front end and a rear end, a flat and elongated seat frame having a front end pivoted to said front end of said base frame and a rear end connected to said rear end of said base frame by a hydraulic cylinder, a sliding seat sliding on said seat frame, first and second handles respectively pivoted to said base frame, two hydraulic cylinders respectively arranged between said first and second handles and said base frame for providing resistance to rowing action; a V-shaped rocker arm having a front end, a middle, and a rear end; two pedals bars arranged on said front end of said rocker arm, and two pedals respectively pivoted to said two pedal bars, wherein said rocker arm is in an arrangement between said base frame and said seat frame for permitting said seat frame to oscillate up and down when said sliding seat is moved back and forth on said seat frame during operation of said rowing machine; said arrangement of said rocker arm including said middle of said rocker arm pivoted to said base frame with said front and rear ends of said rocker arm extending upward, a roller provided on said rear end of said rocker arm, said roller contacting an underside of said seat frame and rolling thereon, and said front end of said rocker art arranged underneath said front of said seat frame.

* * * * *